US005881874A

United States Patent [19]

McKinney

[11] Patent Number: 5,881,874

[45] Date of Patent: Mar. 16, 1999

[54] MODULAR GUN CASE

[76] Inventor: Steven L. McKinney, P.O. Box 836, West Point, Miss. 39773

[21] Appl. No.: 9,318

[22] Filed: Jan. 20, 1998

[51] Int. Cl.[6] ..... B65D 85/00

[52] U.S. Cl. ..... 206/315.11; 206/523; 206/579; 220/521; 220/4.26

[58] Field of Search ..... 206/317, 523, 206/501, 315.11, 314, 372, 373, 3, 579; 224/911, 913; 220/4.26, 4.27, 521; 190/108–111, 18 A

[56] References Cited

U.S. PATENT DOCUMENTS

| | | | |
|---|---|---|---|
| D. 336,987 | 7/1993 | VanSkiver . | |
| D. 358,255 | 5/1995 | Sharp et al. . | |
| 439,562 | 10/1890 | Richards . | |
| 750,817 | 2/1904 | Crenshaw . | |
| 2,706,036 | 4/1955 | Neal . | |
| 2,781,897 | 2/1957 | Dale . | |
| 3,138,306 | 6/1964 | Bare . | |
| 3,307,755 | 3/1967 | Lentz . | |
| 4,446,900 | 5/1984 | Markovich . | |
| 4,643,494 | 2/1987 | Marleau | 312/111 |
| 4,703,519 | 10/1987 | Krenzel . | |
| 4,809,897 | 3/1989 | Wright, Jr. | 224/282 |
| 5,176,281 | 1/1993 | Fiore | 206/315.11 |
| 5,441,134 | 8/1995 | Carson | 206/314 |
| 5,551,562 | 9/1996 | Beretta . | |

OTHER PUBLICATIONS

Cabela's Fall '97 Catalog by Cabela's Inc., p. 246, Published Fall '97.

*Primary Examiner*—Paul T. Sewell
*Assistant Examiner*—Nhan T. Lam
*Attorney, Agent, or Firm*—Hinkle & Associates, P.C.

[57] ABSTRACT

A modular gun case (10) comprises an elongated bottom section (12) having a rim (28), an elongated lid section (16) having lid upper and lower brims (92, 94), and a top section (14) having a top section peripheral edge (70). The lid section matably engages and closes the bottom section. The top section can matably and removably engage either the lid or bottom sections. In one embodiment, the lid section is pivotally mounted to the bottom section. The sections at the respective rim, lid upper and lower brims, and top section peripheral edge utilize a combination of protrusions (104) and shoulders (102) to matingly engage one another. To secure the top section, lock recesses (72) are provided having juxtaposed lock brackets (74) capable of receiving a lock (76). Gas purge valves (51) are provided in the bottom and top sections. Straps (38) releasably retain the sections together. Wheels (42) rotatably mounted to the bottom section assist an individual in porting the modular gun case from one location to another. A plurality of locking bar latches (106) having locking bars (110) extending therethrough are mounted to the bottom, lid and top sections to releasably mount and lock the lid section to the bottom section and releasably mount and lock the top section to either the lid or bottom sections. The lid section has slotted inserts (98) mounted thereto to receive and transport objects.

16 Claims, 7 Drawing Sheets

MODULAR GUN CASE

BACKGROUND OF THE INVENTION

I. Field of the Invention

The present invention relates generally to the field of carrying cases for storage, protection and transportation of sporting equipment. More particularly, the present invention relates to a modular gun case acceptable by the air carrier industry for transporting firearms, bows, arrows, golf clubs, and the like, on commercial airlines.

II. Description of the Related Art

Typically, hard-shell firearm carrying cases have two metal or plastic shells attached on one side by one or more mechanical hinges for folding the firearm carrying case into an open or a closed position. Releasably attached on the opposite side of the firearm carrying case are one or more mechanical latches for securing the firearm carrying case in the closed position. A locking rod system can be utilized with the latches to further secure the two shells together. Each shell contains a foam bedding which interlocks with each other upon closing the firearm carrying case. One or two handles are attached to the latching side to facilitate carrying the firearm carrying case. However, such a firearm carrying case is not capable of matingly engaging another storage section to act as a functional closure or lid. Nor does such a firearm carrying case have a removable lid which is capable of receiving items for additional storage. Examples of such firearm carrying cases are market by Cabela as "'Bullet Proof' Aluminum Cases" and by Doskocil as "Gun Guard" cases.

U.S. Pat. No. 5,551,562 issued to Beretta describes a carrier-suitcase for sports guns, their spare parts and equipment for the user. This device has a body with front and rear sides. The body is provided with wheels allowing the body to be moved on wheels as a carrier and is provided with a grip element allowing the body to be carried as a suitcase. The interior of the body has a plurality of spaces or compartments. The spaces are accessible in part on the front side and in part on the rear side. At least some of the spaces which are accessible on the front side are closed by a shutter or sliding gate. Spaces which are accessible on the rear side are closed by a door, which is hinge-mounted onto the body.

SUMMARY OF THE INVENTION

In accordance with the present invention and the contemplated problems which have and continue to exist in this field, one of the objectives of this invention is to provide a modular gun that is new and distinct over the prior art.

It is another object of the present invention to provide a modular gun case having matingly engagable bottom, lid and top sections.

Still, it is another object of the present invention to provide a modular gun case that utilizes a combination of protrusions and shoulders to align and releasably seal the lid section to the bottom section and the top section to either the lid or bottom sections.

Yet, it is another object of the present invention to provide a modular gun case that has a lid pivotally mounted to a bottom section that is capable of removably receiving a top section.

This invention accomplishes the above and other objectives and overcomes the disadvantages of the prior art by providing a modular gun case that is simple in design and construction, inexpensive to fabricate, and easy to use. A modular gun case comprises an elongated bottom section having a rim, an elongated lid section having lid upper and lower brims, and a top section having a top section peripheral edge. The lid section matably engages and closes the bottom section. The top section can matably and removably engage either the lid or bottom sections. In one embodiment, the lid section is pivotally mounted to the bottom section. The sections at the respective rim, lid upper and lower brims and top section peripheral edge utilize a combination of protrusions and shoulders to matingly engage one another. To secure the top section, lock recesses are provided having juxtaposed lock brackets capable of receiving a lock. Gas purge valves are provided in the bottom and top sections. Straps releasably retain the sections together. Wheels rotatably mounted to the bottom section assist an individual in porting the modular gun case from one location to another. A plurality of locking bar latches having locking bars extending therethrough are mounted to the bottom, lid and top sections to releasably mount and lock the lid section to the bottom section and releasably mount and lock the top section to either the lid or bottom sections. The lid section has slotted inserts mounted thereto to receive and transport objects.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Other objects, advantages and capabilities of the invention will become apparent from the following description taken in conjunction with the accompanying drawings showing preferred embodiments of the invention.

BRIEF DESCRIPTION OF THE DRAWINGS

The invention will be better understood and the above objects as well as objects other than those set forth above will become apparent when consideration is given to the following detailed description thereof. Such description makes reference to the annexed drawings wherein.

Figure 2:
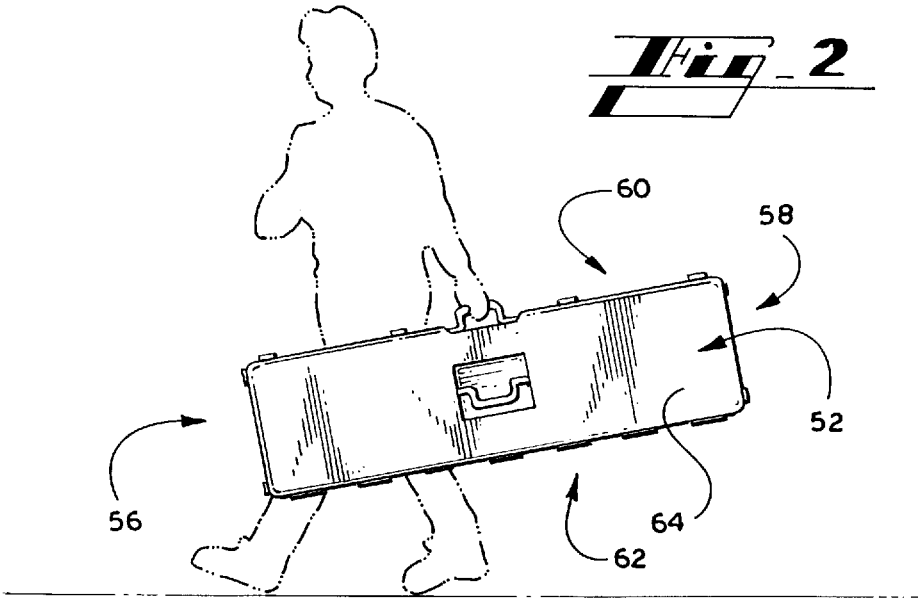
FIG. 2 is a plan view of the top section of FIG. 1 separated from the bottom section and in use.

The reference numbers in the drawings relate to the following:

10 = modular gun case
12 = bottom section
14 = top section
16 = lid section
18 = floor of bottom section
20 = first side of bottom section
22 = second side of bottom section
24 = front side of bottom section
26 = back side of bottom section
28 = rim of bottom section
30 = bottom section inner wall
32 = pad
34 = strap slot
36 = strap rod
38 = strap
40 = wheel well
42 = wheel
44 = axle
46 = grip slot
48 = grip
50 = rest
51 = gas purge valve
52 = upper shell of top section
54 = lower shell of top section
56 = first face of top section
58 = second face of top section
60 = front face of top section
62 = back face of top section
64 = upper face of upper shell
66 = lower face of lower shell
68 = hinge
70 = top section peripheral edge
72 = lock recess
74 = lock bracket
76 = lock
78 = latch
80 = handle
82 = partition of lid section
84 = first panel of lid section
86 = second panel of lid section
88 = front panel of lid section
90 = back panel of lid section
92 = lid lower brim
94 = lid upper brim
96 = lid interior
98 = insert
100 = arrow
102 = shoulder
104 = protrusion
106 = locking bar latch
108 = bore
110 = locking bar
112 = O-ring

DESCRIPTION OF THE PREFERRED EMBODIMENTS

Figure 1:
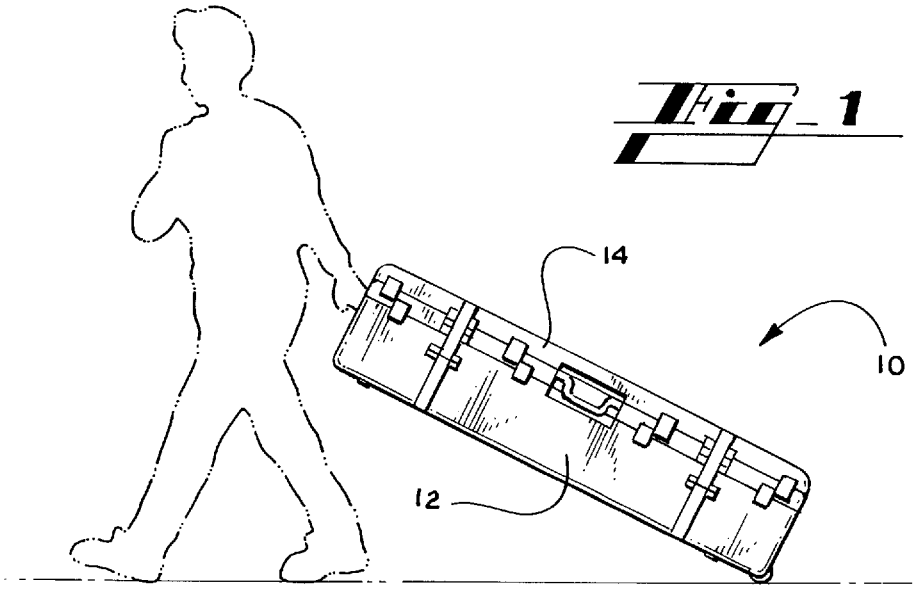
FIG. 1 is a front view of a modular gun case made in accordance with the present invention showing a top section engaging a bottom section.
Figures 5, 6, 7, 8:
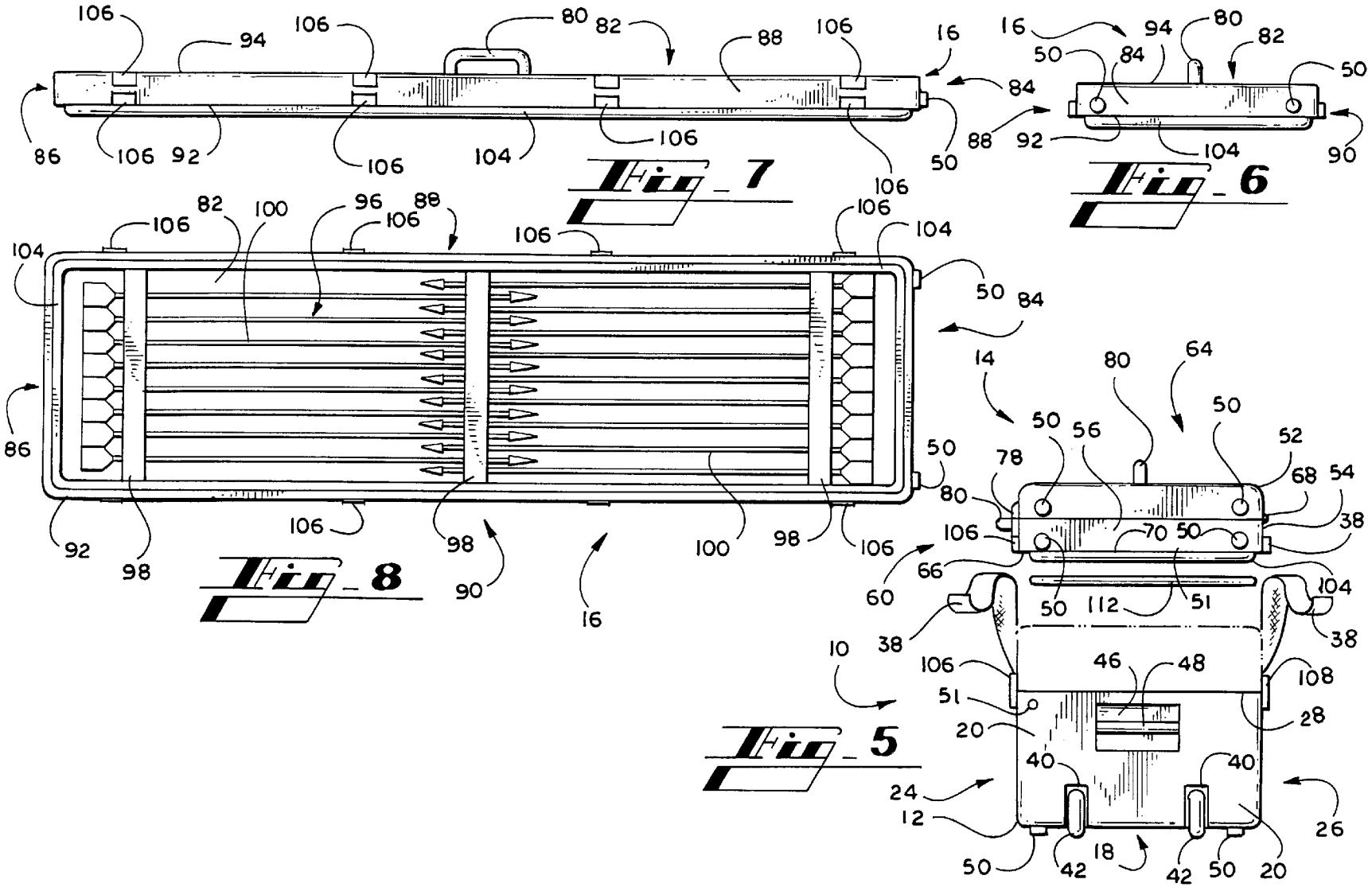
FIG. 5 is a side, exploded view of the embodiment of FIG. 4.
FIG. 6 is a side elevation view of an embodiment of a lid section for removably engaging the bottom and top sections of FIG. 4.
FIG. 7 is a front elevation view of the lid section of FIG. 6.
FIG. 8 is an interior view of the lid section of FIG. 6.
Figure 15:
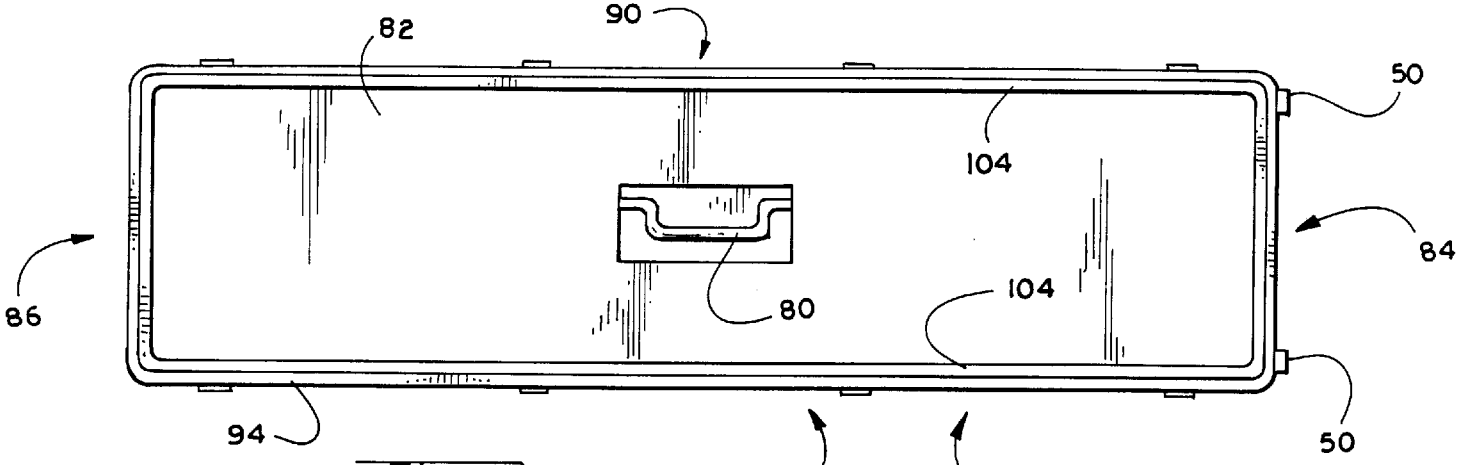
FIG. 15 is a plan view of the lid section of FIG. 12.
Figures 11, 12, 13, 14:
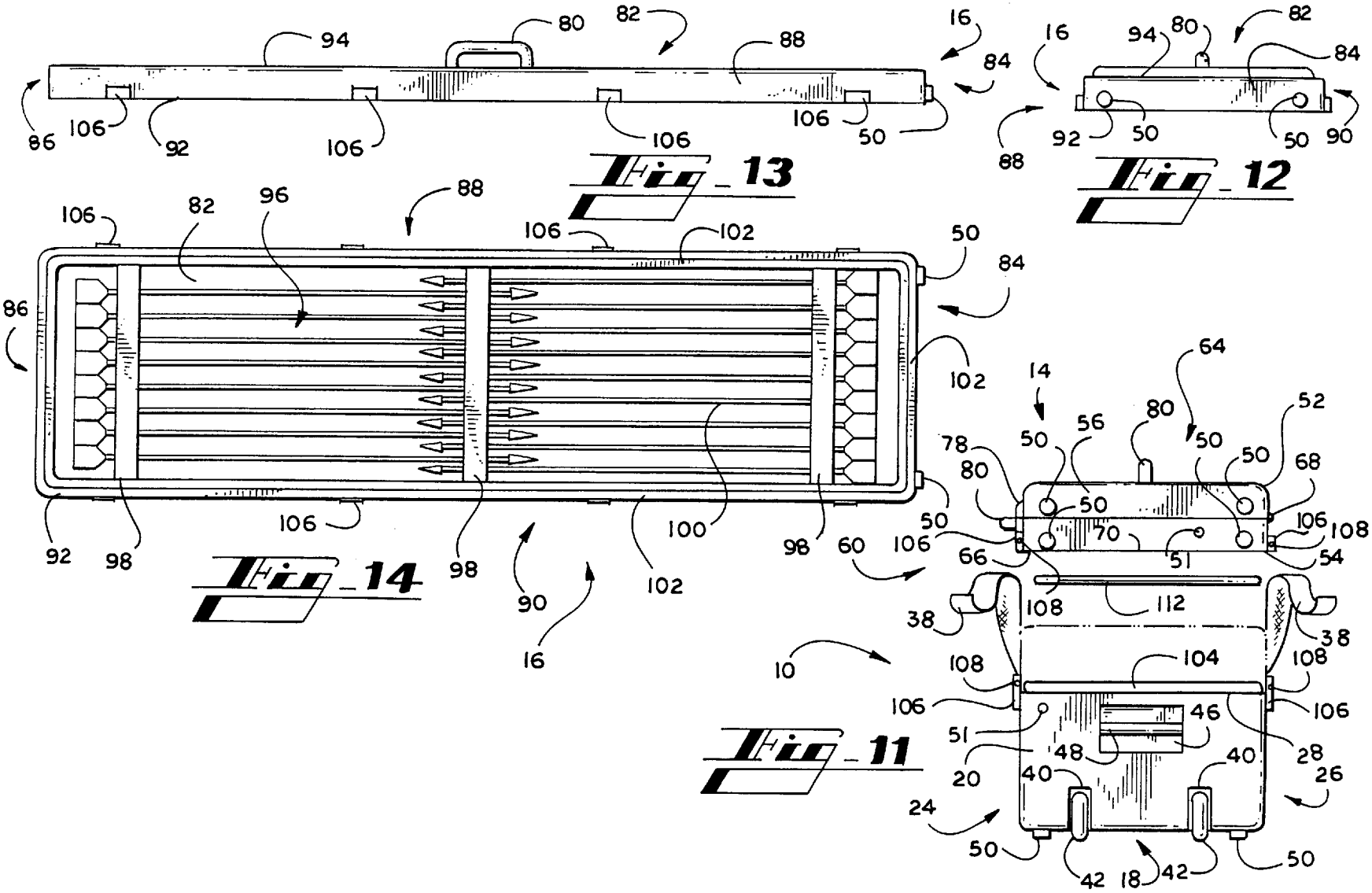
FIG. 11 is a side, exploded view of the embodiment of FIG. 10.
FIG. 12 is side elevation view of another embodiment of the lid section for removably engaging the bottom section of FIG. 10.
FIG. 13 is a front elevation view of the lid section of FIG. 12.
FIG. 14 is an interior view of the lid section of FIG. 12.

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIG. 1. FIG. 1 of the drawings illustrates a modular gun case 10 made in accordance with the present invention. With additional reference to FIGS. 6 and 12, the modular gun case 10 comprises a bottom section 12, a top second 14, and a lid section 16.

Referring generally to FIGS. 1, 3–5, 10, 11, 16 and 17, the bottom section 12 is an elongated, open container having a substantially planar floor 18 with a first side 20, a second side 22, a front side 24 and a back side 26 extending upwardly therefrom and terminating at a rim 28. Disposed between the first and second sides 20 and 22 is a longitudinal axis, and the front and back sides 24 and 26 are substantially parallel to the longitudinal axis. Congruent with the first, second, front and back sides 20, 22, 24 and 26 within the bottom section 12 is a bottom section inner wall 30. Removably disposed within the bottom section 12 are pads 32 which provide protection to objects, such as rifles (not shown) and bows (not shown), placed within the bottom section 12 for shipment. Located on the front side 24 are a pair of spaced apart strap slots 34 which respectively contain strap rods 36. Although not shown, the back side 26 likewise has another pair of spaced apart strap slots 34 with strap rods 36. Straps 38 are provided to releasably secure the top section 14 and/or lid section 16 to the bottom section 12. Conventional securing means, such as buckles, stays, clasps, hook and loop material, etc., are utilized to releasably secure the straps 38 to the modular gun case 10. The straps 38 are positioned through the strap slots 34 and behind the strap rods 36 to retain the straps 38 on the modular gun case 10. Intersecting the bottom and first sides 18 and 20 are a pair of spaced apart wheel wells 40. Respectively and rotatably mounted within the wheel wells 40 are wheels 42, which are provided to assist an individual in conveying the modular gun case 10 from one location to another. Preferably, the wheels 42 are rotatably mounted to a single axle 44. Proximate the rim 28 on the first and second sides 20 and 22 are grip slots 46. Grips 48 are respectively mounted within the grip slots 46. Rests 50 are mounted to the floor 18 to engage the ground. To prevent pressure from building within the bottom section 12 during transport, a gas purge valve 51 is disposed through the first side 20.

Figure 3:
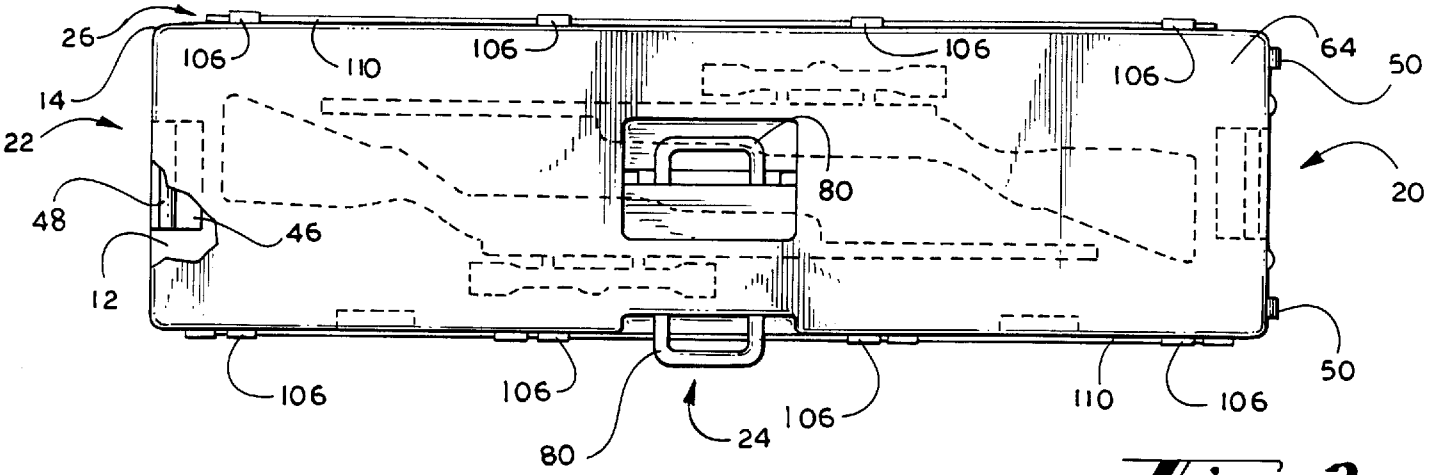
FIG. 3 is a plan view of the modular gun case of FIG. 1 with the top section being partially cut-away to show a grip of the bottom section.
Figure 4:
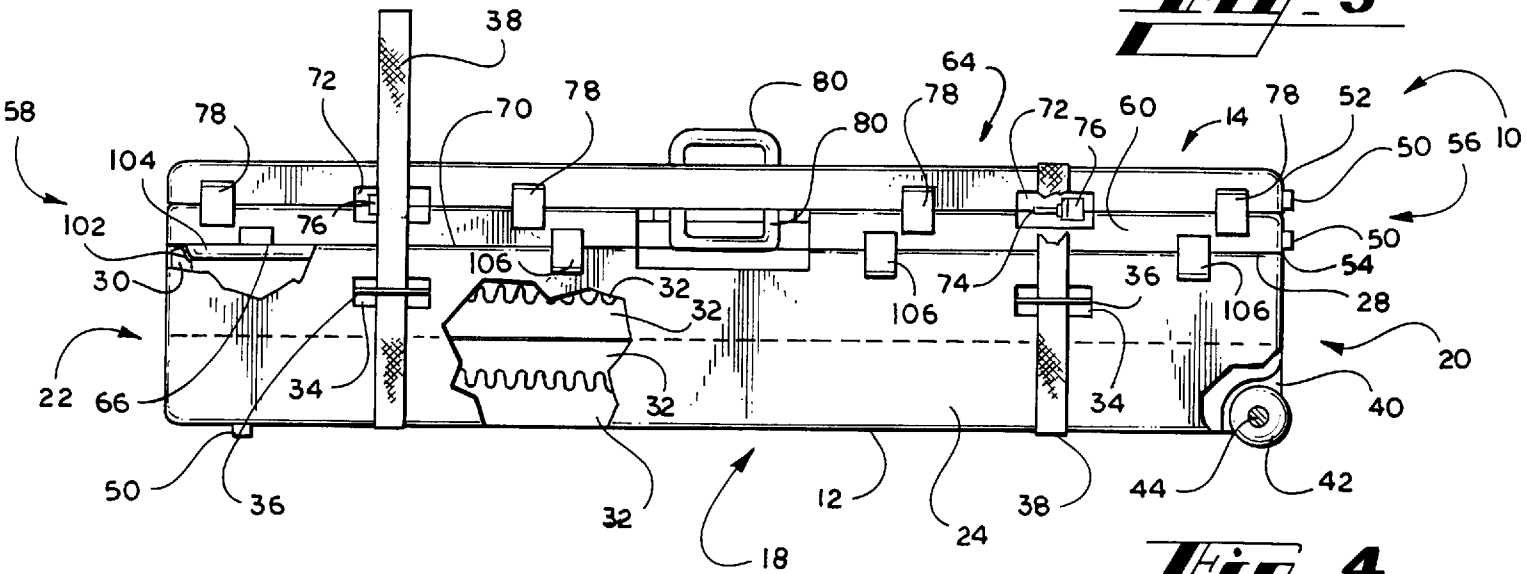
FIG. 4 is a partially cut-away, front elevation view of one embodiment of the present invention showing the bottom section having a shoulder to receive a lip of the top section.

As shown in FIGS. 1–3, the top section 14 is a carrying case that is removable from the modular gun case 10. The individual may transport the modular gun case 10 to a main location and thereafter remove the top section 14 from the modular gun case 10 and port objects placed therein to an alternate location. Preferably, as shown in FIG. 3, the top section 14 is capable of receiving a pair of rifles as indicated by the hidden lines. The internal structure and components of the top section 14 are conventional and do not form a part of this invention.

Now, referring generally to FIGS. 1–5, 10, 11, 16 and 17, the top section 14 comprises elongated, mating upper and lower shells 52 and 54, and the shells 52 and 54 in combination form a first face 56, a second face 58, a front face 60 and a rear face 62. The upper and lower shells 52 and 54 respectively have upper and lower faces 64 and 66 connected to the first, second, front and rear faces 56, 58, 60 and 62. Along the intersection of the upper and lower shells 52 and 54 at the rear face 62, the shells 52 and 54 are pivotally mounted to one another, preferably by a piano hinge 68. The intersection of the lower face 66 and the first, second, front and rear faces 56, 58, 60 and 62 define a top section peripheral edge 70. On the front face 60 are a pair of spaced apart lock recesses 72. Preferably, the lock recesses 72 are respectively positioned the same distance from the first and second faces 56 and 58 as the strap slots 34 are respectively positioned from the first and second sides 22 and 24. By providing this alignment of the lock recesses 72 and the strap slots 34, the straps 38 are capable of covering the lock recesses 72 when secured. Within each lock recess 72 are a pair of juxtaposed lock brackets 74 capable of receiving a lock 76, which prevents the top section 14 from undesired opening. One lock bracket 74 extends from the upper shell 52, and the other lock bracket 74 extends from the lower shell 54. Conventional latches 78 are mounted to the upper and lower shells 52 and 54 along the front face 60 to secure the top section 14. Pivotally mounted to the front and upper faces 60 and 64 are handles 80 to assist the individual in porting the modular gun case 10 and the top section 14. Rests 50 are also mounted to the first face 56. Another gas purge valve 51 extends through the first face 56 of the lower shell 54.

With general reference directed to FIGS. 6–9 and 12–17, the lid section 16 is an elongated closure provided to secure the bottom section 12. The lid section 16 comprises a partition 82 and a first panel 84, a second panel 86, a front panel 88 and a back panel 90. The first, second, front and back panels 84, 86, 88 and 90 extend from the partition 82 and terminate at a lid lower brim 92. A lid upper brim 94 is defined by the intersection of the partition 82 and the first, second, front and back panels 84, 86, 88 and 90. The space between the partition 82 and the lid lower brim 92 is defined as the lid interior 96. Mounted to the partition 82, the front panel 88 and the back panel 90 within the lid interior 92 are slotted, foam inserts 98 that are capable of receiving and retaining objects, such as arrows 100, golf clubs (not shown) and the like. Another handle 80 is pivotally mounted to the partition 82. Additionally, rests 50 are mounted to the first panel 84.

As shown in the drawings, the lid section 16 is adapted to receive the top section 14. In this manner the modular gun case 10 can be transported with both the top and lid sections 14 and 16 secured to the bottom section 12. Once the individual arrives at the desired location, the top section 14 can be removed from the lid section 16 without loss of security for the articles stored within the bottom section 12.

Figure 9:
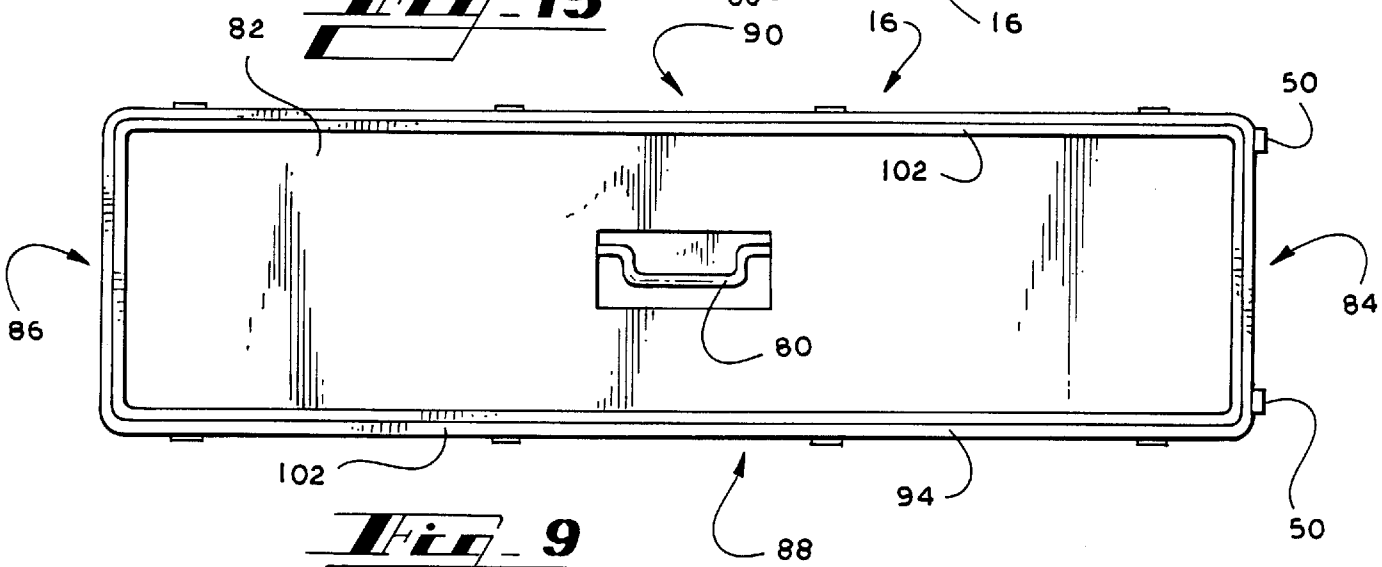
FIG. 9 is a plan view of the lid section of FIG. 6.
Figure 10:
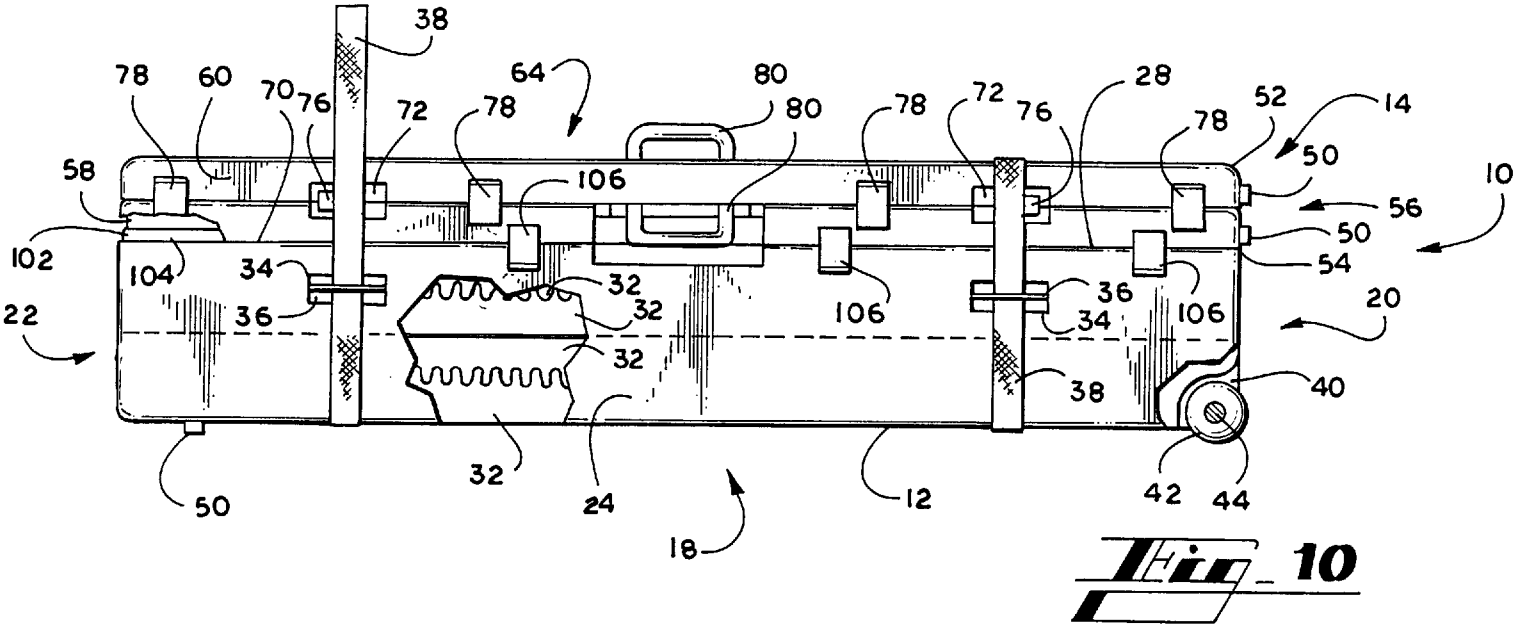
FIG. 10 is a partially cut-away, front elevation view of another embodiment of the present invention showing the bottom section having the lip to engage the shoulder of the top section.

In the embodiment of the modular gun case 10 shown in FIGS. 4–9, the bottom section inner wall 30 has an annular indentation which forms a shoulder 102 proximate the rim 28. Extending outwardly from the lid lower brim 92 is an annular protrusion 104 which matingly and removably engages the shoulder 102 of the bottom section 12 as the lid lower brim 92 removably engages the rim 28. As shown in FIG. 9, this embodiment of the lid section 16 has another annular shoulder 102 extending inwardly proximate the lid upper brim 94 to the partition 82. The top section 14 likewise has an annular protrusion 104 extending outwardly from the top section peripheral edge 70. The protrusion 104 of the top section 14 can removably engage the shoulders 102 of either the bottom section 12 or the lid section 16.

Referring to FIGS. 10–15, another embodiment of the modular gun case 10 is shown. In this embodiment, the bottom section 12 has the annular protrusion 104 extending outwardly from the rim 28. With this configuration, the lid section 16 has the annular shoulder 102 extending inwardly proximate the lid lower brim 92 to removably and matingly engage the shoulder 102 of the bottom section 12. As well, the lid section 16 has another annular protrusion 104 extending outwardly from the lid upper brim 94. The top section 14 has another annular shoulder 102 extending inwardly from the top section peripheral edge 70 to the lower face 66 to removably and matingly engage either the protrusions 102 of the bottom section 12 or the lid section 16.

Obviously, the lid section 16 can be manufactured having protrusions 104 extending outwardly from the lid lower and upper brims 92 and 94 to removably engage bottom and top sections 12 and 14 having shoulders 102. Also, the lid section 16 can be manufactured having shoulders 102 extending inwardly from the lid lower and upper brims 92 and 94 to removably engage bottom and top sections 13 and 14 having protrusions 104.

Figure 17:
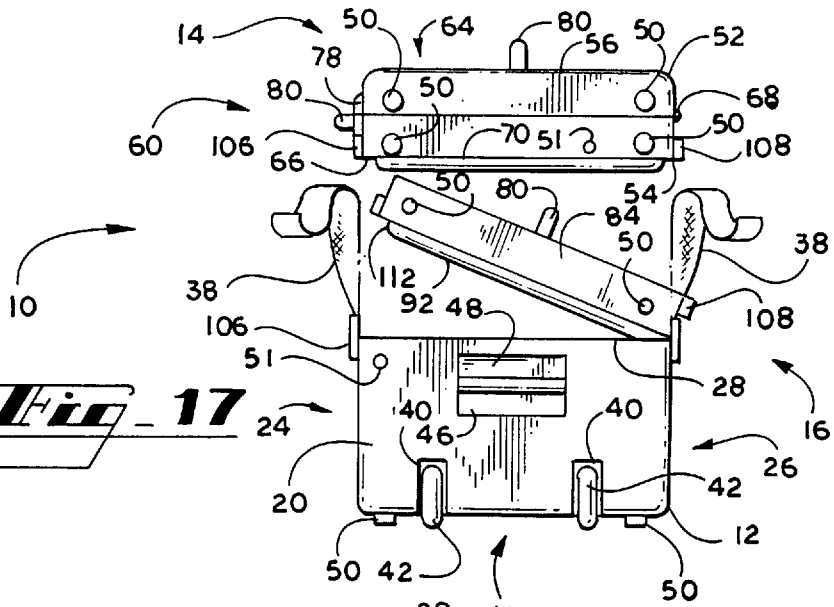
FIG. 17 is a side, exploded view of another embodiment of the present invention showing the lid section pivotally mounted to the bottom section.
Figure 16:
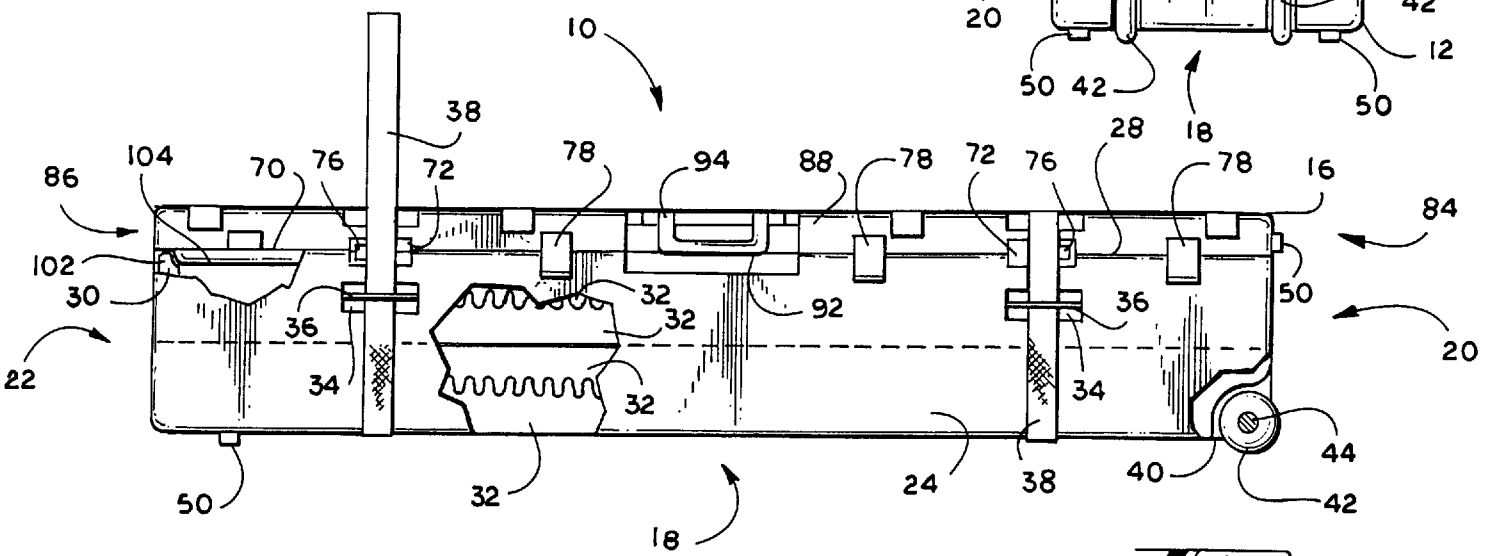
FIG. 16 is a partially cut-away, front elevation view of another embodiment of the present invention showing the bottom section engaging the lid section.

Yet, another embodiment is shown in FIGS. 16 and 17. In this embodiment, the lid section 16 is pivotally mounted to the bottom section 12 along the intersection of the back side 26 and the back panel 90. Latches 78 are mounted to the front side 24 and the front panel 88 to releasably secure the lid section 16 to the bottom section 12. In this embodiment, the lid section 16 and the bottom section 12 in combination have spaced apart lock recesses 72 having lock brackets 74, as described with the top section 14 above.

Again, referring generally to FIGS. 1–17, to secure either the top section 14 to the lid section 16 or a removable lid section 16 to the bottom section 12, locking bar latches 106 are respectively mounted to the front and back sides 24 and 26, the front and back faces 60 and 62, and the front and back panels 88 and 90. The locking bar latches 106 have bores 108 which removably receive locking bars 110. The locking bars 110 prevent the locking bar latches from opening and thereby releasing the respective sections 12, 14 and 16.

Preferably, an O-ring 112 is utilized to provide an air and water tight seal between the bottom section and either the top or lid sections 14 and 16. The O-ring 112 is removably placed between the shoulder 102 and the protrusion 104 to form the seal when the applicable section 14 or 16 engages the bottom section 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Additionally, it is not required for the shoulders 102 and the protrusions 104 to be continuous; only that the respective shoulders 102 and protrusions 104 be arranged so they releasably and matingly engage one another.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A modular gun case, comprising:

an elongated bottom section having a substantially planar floor and a first side, a second side, a front side and a back side extending upwardly therefrom and terminating at a rim;

an elongated lid section for engaging and closing the bottom section, the lid section having a partition and a first panel, a second panel, a front panel and a back panel extending from the partition and terminating at a lid lower brim, the intersection of the partition and the first, second, front and back panels defining a lid upper brim, the lid lower brim matingly engaging the rim; and an elongated top section for removably engaging either the lid or bottom sections and receiving objects, the top section comprising an upper shell matingly and pivotally mounted to a lower shell, the upper and lower shells in combination forming a first face, a second face, a front face and a rear face, the lower shell having a lower face connected to the first, second, front and rear faces, the intersection of the lower face and the first, second, front and rear faces defining a top section peripheral edge, the top section peripheral edge matingly and removably engaging the lid upper brim or the rim.

2. A modular gun case as claimed in claim 1, wherein the lid section is pivotally mounted to the bottom section.

3. A modular gun case as claimed in claim 1, wherein the rim of the bottom section has a substantially annular shoulder and the lid lower brim has a substantially annular protrusion extending outwardly therefrom to matingly engage the shoulder.

4. A modular gun case as claimed in claim 3, wherein the top section peripheral edge has another substantially annular protrusion to matingly engage the shoulder of the bottom section.

5. A modular gun case as claimed in claim 4, wherein the lid upper brim has another substantially annular shoulder to matingly receive the protrusion of the top section.

6. A modular gun case as claimed in claim 5, wherein the lid section is pivotally mounted to the bottom section.

7. A modular gun case as claimed in claim 1, wherein the rim of the bottom section has a substantially annular protrusion extending outwardly therefrom and the lid lower brim has a substantially annular shoulder to matingly receive the protrusion.

8. A modular gun case as claimed in claim 7, wherein the top section peripheral edge has another substantially annular shoulder to matingly receive the protrusion of the bottom section.

9. A modular gun case as claimed in claim 8, wherein the lid upper brim has another substantially annular protrusion to matingly engage the shoulder of the top section.

10. A modular gun case as claimed in claim 9, wherein the lid section is pivotally mounted to the bottom section.

11. A modular gun case as claimed in claim 1, wherein the first face of the top section has at least one lock recess, the at least one lock recess has a pair of juxtaposed lock brackets capable of engaging a lock, one lock bracket extends from the upper shell and the other lock bracket extends from the lower shell.

12. A modular gun case as claimed in claim 1, wherein the bottom section has a gas purge valve.

13. A modular gun case as claimed in claim 1, further comprising at least one strap to releasably secure the bottom section to the lid and top sections.

14. A modular gun case as claimed in claim 1, wherein the bottom section has a pair of spaced apart wheel wells intersecting the first side and the floor, and each wheel well has a wheel rotatably mounted therein.

15. A modular gun case as claimed in claim 1, further comprising a plurality of locking bar latches mounted to the bottom, lid and top sections to releasably mount and lock the lid section to the bottom section and releasably mount and lock the top section to either the lid or bottom sections.

16. A modular gun case as claimed in claim 1, wherein the lid section has at least one slotted insert mounted to the partition, the front panel and the back panel for receiving and retaining objects.

* * * * *